US006474707B1

(12) United States Patent
Simonis

(10) Patent No.: US 6,474,707 B1
(45) Date of Patent: Nov. 5, 2002

(54) SLIDING DOOR LOCKING AND VENTING DEVICE

(76) Inventor: Joseph W Simonis, 313 Joy La., West Chester, PA (US) 19380

( * ) Notice: Subject to any disclaimer, the term of this patent is extended or adjusted under 35 U.S.C. 154(b) by 0 days.

(21) Appl. No.: 09/933,433

(22) Filed: Aug. 20, 2001

(51) Int. Cl.[7] ..... E05C 19/18
(52) U.S. Cl. ..... 292/259 R; 292/DIG. 46
(58) Field of Search ..... 292/259 R, 288, 292/292, 289, 262, 339, 343, DIG. 46, 263; 16/82; 403/292

(56) References Cited

U.S. PATENT DOCUMENTS 3,554,592 A * 1/1971 Katz ..... 292/263
3,726,555 A * 4/1973 Lawson ..... 292/291
3,820,285 A * 6/1974 Shiffler ..... 49/450
3,993,336 A * 11/1976 Frost ..... 292/263

* cited by examiner

*Primary Examiner*—Gary Estremsky
(74) *Attorney, Agent, or Firm*—Goldstein & Lavas, P.C.

(57) ABSTRACT

A sliding door locking and venting device including an elongated cylindrical rod having a total length slightly less than a slide track for a sliding door. The cylindrical rod is positionable within the slide track to prevent the sliding door from being moved. The cylindrical rod includes separable first and second sections. The first section is substantially greater in length than the second section. The second section is linearly aligned with the first section in a first orientation within the slide track to prevent the sliding door from being moved. The second section is removed from the slide track in a second orientation to allow the sliding door to be open slightly for ventilation purposes. A connecting cord extends between the first and second sections of the elongated cylindrical rod.

2 Claims, 2 Drawing Sheets

SLIDING DOOR LOCKING AND VENTING DEVICE

BACKGROUND OF THE INVENTION

The present invention relates to a sliding door locking and venting device and more particularly pertains to allowing a sliding door to be blocked from opening and also slightly opened for venting.

The use of security devices is known in the prior art. More specifically, security devices heretofore devised and utilized for the purpose of preventing unauthorized access to a home are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,754,783 to Childers discloses a means for locking a sliding glass door using an elongated bar comprised of two sections, said sections being joined by a hinge. U.S. Pat. No. 4,073,522 to Tierney discloses a pair of bars, pivotally linked together for securing a sliding door. U.S. Pat. No. 4,971,374 to Lovell discloses a home security kit.

While these devices fulfill their respective, particular objective and requirements, the aforementioned patents do not describe a sliding door locking and venting device for allowing a sliding door to be blocked from opening and also slightly opened for venting.

In this respect, the sliding door locking and venting device according to the present invention substantially departs from the conventional concepts and designs of the prior art, and in doing so provides an apparatus primarily developed for the purpose of allowing a sliding door to be blocked from opening and also slightly opened for venting.

Therefore, it can be appreciated that there exists a continuing need for a new and improved sliding door locking and venting device which can be used for allowing a sliding door to be blocked from opening and also slightly opened for venting. In this regard, the present invention substantially fulfills this need.

SUMMARY OF THE INVENTION

In the view of the foregoing disadvantages inherent in the known types of security devices now present in the prior art, the present invention provides an improved sliding door locking and venting device. As such, the general purpose of the present invention, which will be described subsequently in greater detail, is to provide a new and improved sliding door locking and venting device which has all the advantages of the prior art and none of the disadvantages.

To attain this, the present invention essentially comprises an elongated cylindrical rod having a total length slightly less than a slide track for a sliding door. The cylindrical rod is positionable within the slide track to prevent the sliding door from being moved. The cylindrical rod includes separable first and second sections. The first section is substantially greater in length than the second section. The second section is linearly aligned with the first section in a first orientation within the slide track to prevent the sliding door from being moved. The second section is removed from the slide track in a second orientation to allow the sliding door to be open slightly for ventilation purposes. A connecting cord extends between the first and second sections of the elongated cylindrical rod.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sliding door locking and venting device which has all the advantages of the prior art security devices and none of the disadvantages.

It is another object of the present invention to provide a new and improved sliding door locking and venting device which may be easily and efficiently manufactured and marketed.

It is a further object of the present invention to provide a new and improved sliding door locking and venting device which is of durable and reliable construction.

An even further object of the present invention is to provide a new and improved sliding door locking and venting device which is susceptible of a low cost of manufacture with regard to both materials and labor, and which accordingly is then susceptible of low prices of sale to the consuming public, thereby making such a sliding door locking and venting device economically available to the buying public.

Even still another object of the present invention is to provide a new and improved sliding door locking and venting device for allowing a sliding door to be blocked from opening and also slightly opened for venting.

Lastly, it is an object of the present invention to provide a new and improved sliding door locking and venting device including an elongated cylindrical rod having a total length slightly less than a slide track for a sliding door. The cylindrical rod is positionable within the slide track to prevent the sliding door from being moved. The cylindrical rod includes separable first and second sections. The first section is substantially greater in length than the second section. The second section is linearly aligned with the first section in a first orientation within the slide track to prevent the sliding door from being moved. The second section is removed from the slide track in a second orientation to allow the sliding door to be open slightly for ventilation purposes. A connecting cord extends between the first and second sections of the elongated cylindrical rod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
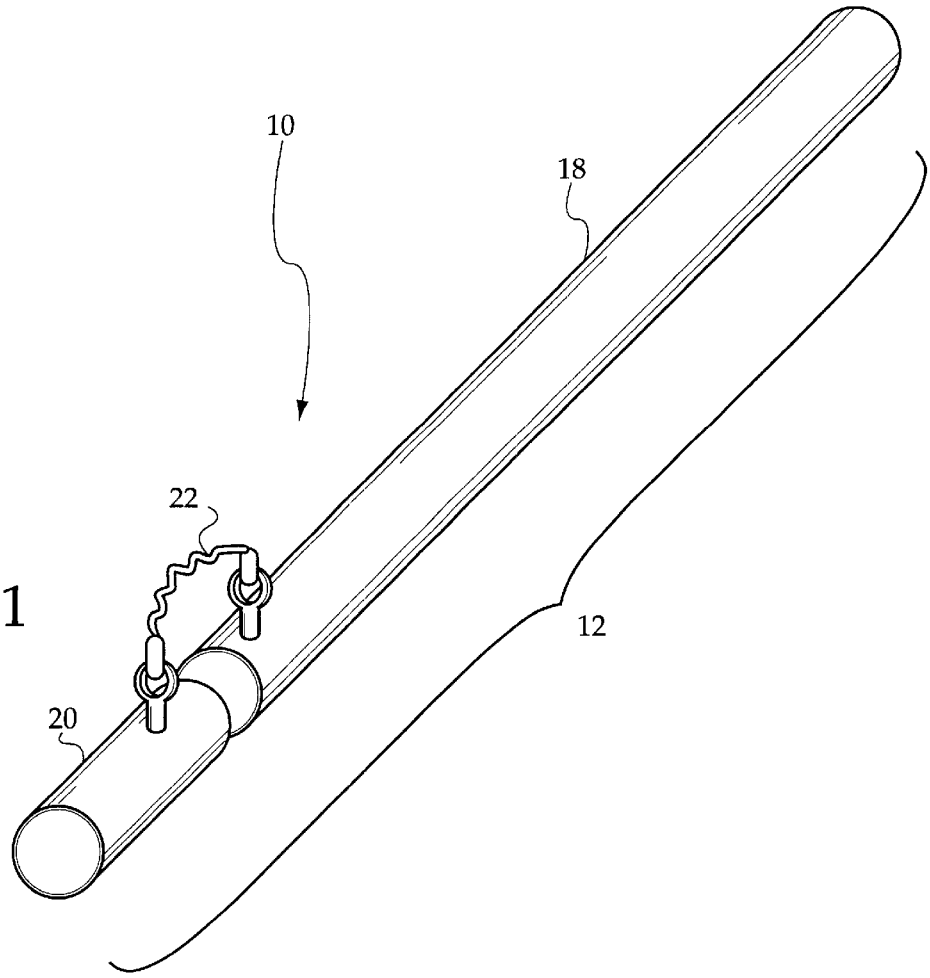
FIG. 1 is a perspective view of the preferred embodiment of the sliding door locking and venting device constructed in accordance with the principles of the present invention.
Figure 3:
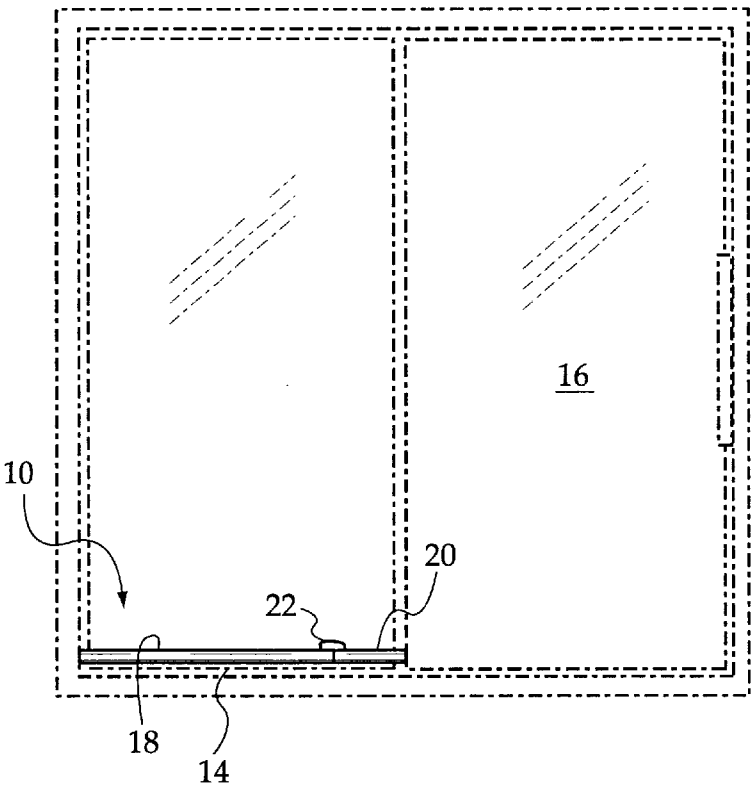
FIG. 3 is a front view of the present invention illustrated in place preventing the sliding door from being opened.
Figure 2:
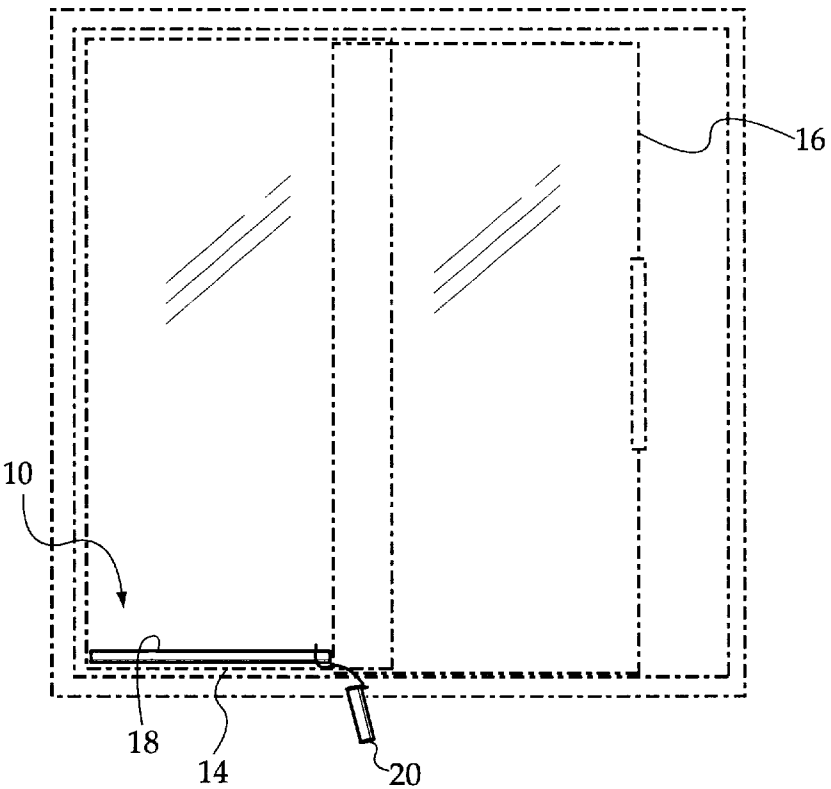
FIG. 2 is a front view of the present invention illustrated in place allowing a sliding door to be slightly opened for venting.

With reference now to the drawings, and in particular, to FIGS. 1 through 3 thereof, the preferred embodiment of the new and improved sliding door locking and venting device embodying the principles and concepts of the present invention and generally designated by the reference number 10 will be described.

Specifically, it will be noted in the various Figures that the device relates to a sliding door locking and venting device for allowing a sliding door to be blocked from opening and also slightly opened for venting. In its broadest context, the device consists of an elongated cylindrical rod and a connecting cord. Such components are individually configured and correlated with respect to each other so as to attain the desired objective.

The elongated cylindrical rod 12 has a total length slightly less than a slide track 14 for a sliding door 16. The cylindrical rod 12 is positionable within the slide track 14 to prevent the sliding door 16 from being moved. The cylindrical rod 12 includes separable first and second sections 18,20. The first section 18 is substantially greater in length than the second section 20. In the preferred embodiment, the first section 18 has a length of about 27.75 inches and the second section 20 has a length of about 4.5 inches. The second section 20 is linearly aligned with the first section 18 in a first orientation within the slide track 14 to prevent the sliding door 16 from being moved. Note FIG. 3. Thus, even if the lock of the sliding door 16 has been compromised, the positioning of the elongated cylindrical rod 12 within the slide track 14 will prevent the sliding door 16 from being moved any more than an inch or so. The second section 20 is removed from the slide track 14 in a second orientation to allow the sliding door 16 to be open slightly for ventilation purposes. Note FIG. 3. In the second orientation, the removal of the second section 20 will only allow the sliding door 16 to be opened about 4.5 inches, or the length of the second section 20. This amount of opening is enough to provide adequate ventilation, but remains too narrow to allow a person to enter there through.

The connecting cord 22 extends between the first and second sections 18,20 of the elongated cylindrical rod 12. Essentially, the connecting cord 22 is used to prevent the second section 20 from being lost when removed from the slide track 14 in the second orientation. The connecting cord 22 will keep the second section 20 close by to be repositioned within the slide track 14 when needed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A sliding door locking and venting device for allowing a sliding door to be blocked from opening and also slightly opened for venting comprising, in combination:

an elongated cylindrical rod having a total length slightly less than a slide track for a sliding door, the cylindrical rod being positionable within the slide track to prevent the sliding door from being moved, the cylindrical rod including separable first and second sections, the first section being greater in length than the second section, the second section being linearly aligned with the first section in a first orientation within the slide track preventing the sliding door from being moved, the second section being removed from the slide track in a second orientation allowing the sliding door to be open slightly for ventilation purpose; and a connecting cord extending between the first and second sections of the elongated cylindrical rod.

2. A sliding door locking and venting device for allowing a sliding door to be blocked from opening and also slightly opened for venting comprising, in combination:

an elongated cylindrical rod having a total length slightly less than a slide track for a sliding door, the cylindrical rod being positionable within the slide track to prevent the sliding door from being moved, the cylindrical rod including separable first and second sections, the first section being greater in length than the second section, the second section being linearly aligned with the first section in a first orientation within the slide track preventing the sliding door from being moved, the second section being removed from the slide track in a second orientation allowing the sliding door to be open slightly for ventilation purposes; and connecting means coupled with the first and second sections of the elongated cylidrical rod for allowing multi-axial pivoting, the connection means preventing the second section from becoming lost when removed from the slide track in the second orientation.

* * * * *